United States Patent [19]

Fisher

[11] 4,176,713

[45] Dec. 4, 1979

[54] PLATE-TYPE HEAT EXCHANGER

[76] Inventor: Helmut Fisher, Kuniglberggasse 5, Vienna, Austria, 1130

[21] Appl. No.: 766,172

[22] Filed: Feb. 7, 1977

[30] Foreign Application Priority Data

Feb. 12, 1976 [IT] Italy ..... 20115 A/76

[51] Int. Cl.[2] ..... F28F 3/04

[52] U.S. Cl. ..... 165/166

[58] Field of Search ..... 165/166, 167

[56] References Cited

U.S. PATENT DOCUMENTS

| | | | |
|---|---|---|---|
| 3,151,675 | 10/1964 | Lysholm | 165/166 |
| 3,661,203 | 5/1972 | Mesher | 165/167 |
| 3,690,373 | 9/1972 | Wright | 165/167 X |
| 3,731,737 | 8/1973 | Jenssen | 165/167 |
| 3,783,090 | 1/1974 | Andersson et al. | 165/166 |

FOREIGN PATENT DOCUMENTS

| | | | |
|---|---|---|---|
| 2109346 | 10/1971 | Fed. Rep. of Germany | 165/167 |

OTHER PUBLICATIONS

*Alfa-Flex*, ALFA-LAVAL, Sweden, 12/1975, No. PC60515E, 1972.

*Primary Examiner*—Albert W. Davis, Jr.
*Attorney, Agent, or Firm*—Karl W. Flocks

[57] ABSTRACT

At least three heat exchange plates which are press-formed from sheet metal are arranged in a row and have a fluid-guiding body each, which is formed with a plurality of corrugations which have ridges that define two parallel ridge planes on opposite sides of said plate. Spacing means which are rigid with each of said plates and flush with one of said ridge planes thereof extend between said ridges only in part of the length of said corrugations of said plate and contact the ridges of an adjacent plate. Said plates comprising first and second types of plates. Said corrugations of said plates of said first and second types, respectively, extend at equal and opposite, oblique angles to a center plane of said body which is normal to said ridge planes and have the same cross-section so that the center spacing of said plates equals the height of said corrugations. At least two adjacent ones of said plates have adjacent corrugations which are parallel to each other. At least two adjacent ones of said plates have adjacent corrugations which cross each other.

7 Claims, 9 Drawing Figures

PLATE-TYPE HEAT EXCHANGER

This invention relates to a plate-type heat exchanger comprising two thick plates and three or more heat exchange plates, which consist of pressed sheet metal and are gripped between the thick plates and arranged in a row and have a fluid-guiding body which is surrounded by a gasket that is seated in a recessed flange of the heat exchange plate.

In most plate-type heat exchangers, similar influences are exerted on the flow of fluids in two adjacent chambers between plates so that the heat will be transferred at the same rates through the chambers on both sides of a given heat exchange plate if the two fluids have the same physical properties and flow at equal rates through both chambers. Under these conditions the pressure losses are also equal.

In many cases, however, plate-type heat exchangers must be used for a heat exchange between fluids flowing at greatly different rates. To avoid an excessive resistance to the flow of the fluid at the higher flow rate, it is then necessary to provide for the flow of that fluid a larger number of flow passages connected in parallel than for the fluid which flows at a lower rate. So far, it has been attempted to avoid this disadvantage by designing plate-type heat exchangers which exert different influences on the flow of fluids in adjacent chambers between plates. This has normally been accomplished in that those chambers between plates which are intended to handle higher flow rates are enlarged in that the spacing of the plates is increased.

For this purpose, these plates are in most cases provided with gaskets which are thicker than normal, although this has the disadvantage that the fluid-guiding bodies of the plates which are spaced a larger distance apart no longer contact and support support each other, as is otherwise usual to maintain a constant spacing between the plates. When the fluid pressure in the wider chambers is lower than in the narrower ones, the plates will be deflected so that the wider chambers will be constricted and the resistance to flow therein will increase.

It has also been proposed to arrange similar plates in a row in pairs in such a manner that alternate interfaces between the plates are defined by forward and rear faces, respectively, of the contacting plates so that there are two types of chambers, which exert different influences on the flow of the fluids between heat is exchanged. That proposal gives rise to a sealing problem because these chambers could be sealed toward both sides only if the plates were provided with two gaskets arranged on both sides and this is not practicable with plates of pressed sheet metal. For this reason that proposal has not been accepted in practice.

It is an object of the invention to provide plate-type heat exchangers in which the plates are spaced equal distances apart and flow paths having different flow-influencing properties are respectively provided for the two fluids between which heat is exchanged so that the heat exchanger can be adapted as closely as possible to changing requirements.

The invention provides at least two types of heat exchange plates, which form flow path chambers having different flow-influencing properties. The plates are provided in known manner with numerous embossed corrugations, which extend at an oblique angle to the direction of flow and have a height which is equal to the center spacing of the plates. Numerous connecting webs or embossed knobs are provided between the corrugations and are as high as the latter. The corrugations of the plates of the two types have the same cross-section and include opposite angles of inclination with a center line of the plate. The plates are arranged in a row in such a manner that the corrugations of some adjacent plates cross each other and those of other adjacent plates are parallel to each other.

Fluid flow chambers defined by parallel corrugations present a much lower resistance to fluid flow than fluid flow chambers defined by crossing corrugations.

The design according to the invention permits of the provision of a heat exchanger in which the flow path for the first fluid has other flow-influencing properties than the flow path for the second fluid if alternate chambers are defined by crossing corrugations and parallel corrugations respectively. Alternatively, the flow path for one and the same fluid may be defined in one part by crossing corrugations and in another part by parallel corrugations. This enables a particularly close matching of the thermal characteristics of the plate-type heat exchanger to the requirements.

Two embodiments of the invention are shown by way of example on the accompanying drawing, in which FIGS. 1, 2, 3, 4 are elevations showing heat exchange plates of a heat exchanger according to the invention in the order in which they succeed each other in the heat exchanger when flow paths having different flow-influencing characteristics are desired for the two fluids.

Figures 1, 2, 3, 4:
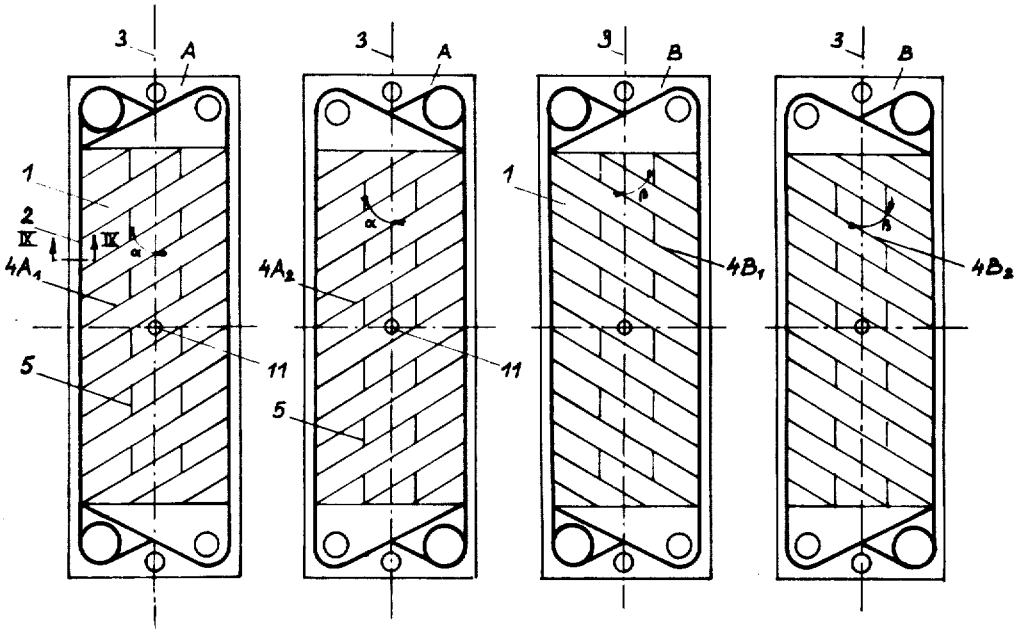
Figure 9:
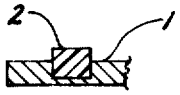
FIG. 9 is an enlarged partial cross-section view along line IX—IX of FIG. 1.

FIG. 1 shows a plate A which has a fluid guiding body 1 that is surrounded by a gasket 2. As is usual in such plate-type heat exchangers, the gasket 2 is seated in a recessed flange, in body 1, as shown in FIG. 9. The rectangular body of the plate is formed with corrugations $4A_1$, which extend at an oblique angle to the longitudinal axis 3 of the plate and which have height which is equal to the center spacing of the plates. The corrugations are interconnected by webs 5, which have the same height as the corrugations. The ridges of the corrugations and the connecting webs are represented by solid lines. Alternatively, the connecting webs might be provided on the underside and connect the troughs of the corrugations.

When the plate 1 shown in FIG. 1 is rotated through 180° about its center line 11, which is at right angles to the plane of the plate, the plate shown in FIG. 2 is obtained, which has corrugations $4A_2$ that are congruent with those of the plate of FIG. 1 but in which the webs 5 are so arranged that when two such plates rotated through 180° relative to each other are superimposed the webs 5 of each plate bear on the corrugations of the adjacent plate to provide for the required support.

FIG. 3 shows a plate B which differs from the plate shown in FIG. 1 in that the corrugations $4B_1$ provided on the body 1 of the plate include an angle B with the longitudinal axis whereas the corrugations of the body 1 of the plate A of FIG. 1 include with the longitudinal axis of the plate an equal but opposite angle $\alpha$. When the plate of FIG. 3 is laid on that of FIG. 2, the corrugations defining the chamber between the plates will cross each other so that high heat transfer rates will be obtained even at low velocities of flow. Just as the plate of FIG. 2 is related to that of FIG. 1, the plate shown in FIG. 4 is obtained in that the plate of FIG. 3 is rotated so that the plates of FIGS. 3 and 4 can be combined so that the chamber between them is defined by parallel corrugations. When the plate of FIG. 4 is succeeded by another set of plates as shown in FIGS. 1 to 4, alternate chambers of the entire arrangement will be defined by parallel corrugations and by crossing corrugations, respectively.

Figures 5, 6, 7, 8:
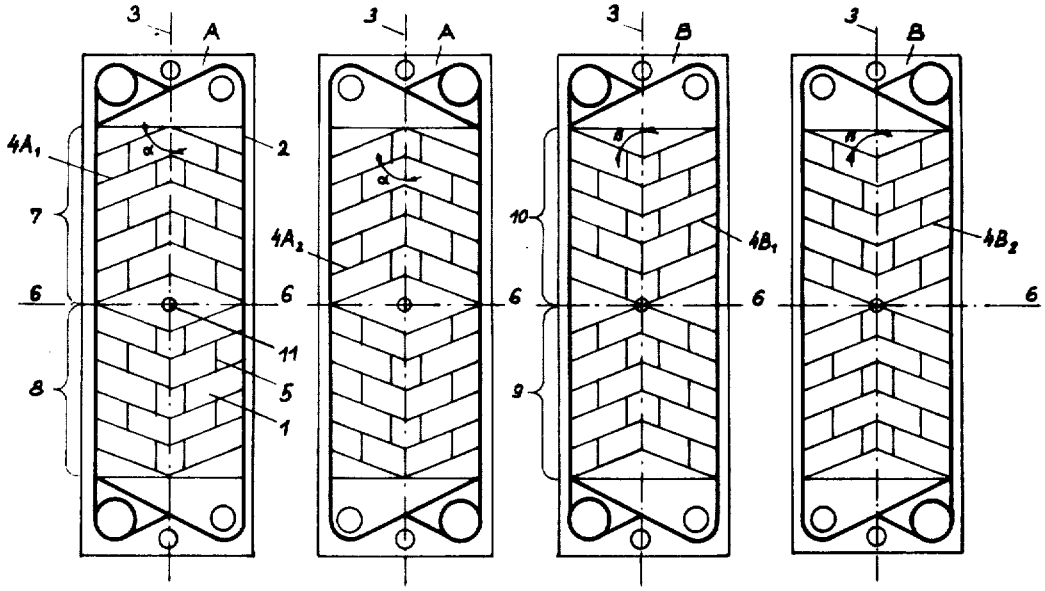
FIGS. 5, 6, 7 and 8 show a similar heat exchanger in which each heat exchange plate has a body which is symmetric with respect to the transverse axis of the plate.

In the embodiment shown in FIGS. 5 to 8, the plates have bodies formed with embossed corrugations which are symmetrical with respect to the transverse center plane 6 of the plate. The webs are so arranged that when two plates having identical corrugations are superimposed (FIGS. 5 and 6) the webs of the lower plate bear on the lower ridges of the corrugations of the upper plate to support the same. A plate shown in FIG. 6 is obtained in that a plate as shown in FIG. 5 is rotated through 180° about the axis 11. The fluid flow chamber between the plates of FIGS. 6 and 7 is defined by crossing corrugations.

The upper half 7 of the body of the plateshown in FIG. 5 is identical to the lower half 9 of the body of the plate shown in FIG. 7. The lower half 8 of the body of the plate shown in FIG. 5 is identical to the upper half 10 of the body of the plateshown in FIG. 7. This embodiment has the advantage, inter alia, that the one and the same tool can be used to press the plates if only parts of the tools are interchanged, so that the tooling costs are greatly reduced.

What is claimed is:

1. A plate-type heat exchanger, which comprises at least three heat exchange plates which consist of press-formed sheet metal and are arranged in a row and have a fluid-guiding body each, which is formed with a plurality of corrugations which have ridges that define two parallel ridge planes on opposite sides of said plate, and spacing means which are rigid with each of said plates and flush with one of said ridge planes thereof and extend between said ridges only in part of the length of said corrugations of said plate and contact the ridges of an adjacent plate, said plates comprising first and second types of plates, said corrugations of said plates of said first and second types, respectively, extending at equal and opposite, oblique angles to a center plane of said body which is normal to said ridge planes and having the same cross-section so that the center spacing of said plates equals the height of said corrugations, at least two adjacent ones of said plates having adjacent corrugations which are parallel to each other, and at least two adjacent ones of said plates having adjacent corrugations which copies each other.

2. A plate-type heat exchanger as set forth in claim 1, in which said two adjacent plates having corrugations which are parallel to each other consist of plates of the same type and said two adjacent plates having corrugations which cross each other consist of plates of both said types.

3. A plate-type heat exchanger as set forth in claim 2, in which adjacent plates define chambers between them, one plate of a pair of adjacent type of the first type and one plate of a pair of adjacent plates of the second type are disposed adjacent to each other, said chamber between said adjacent plates belonging to both said types is connected to a flow path for a first fluid, and said chambers between the plates of said pairs are connected in series to each other in a flow path for a second fluid.

4. A plate-type heat exchanger as set forth in claim 2, in which the plates of each type are identical to each other and adjacent plates of the same typehave orientations which are 180° offset from each other with respect to a common center line which is normal to said ridge planes.

5. A plate-type heat exchanger as set forth in claim 1, in which said spacing means comprise webs which are transverse to said corrugations.

6. A plate-type heat exchanger as set forth in claim 1, in which said center plane of each of said bodies is a median plane thereof.

7. A plate-type heat exchanger as set forth in claim 6, in which said body of each of said plates is rectangular, said corrugations of each of said plates are symmetrical with respect to a transverse center plane which is at right angles to said median plane and normal to said ridge planes, said plates are arranged so that said first and second halves, respectively, of the bodies of all said plates are disposed on the same side of said transverse center plane, said corrugations and spacing means provided in said first half of the body of each plate of said first type and in said second half of the body of each plate of said second type are respectively identical, said corrugations and spacing means provided in said second half of the body of each plate of said first type and in said first half of the body of each plate of said second plate are respectively identical.

* * * * *